US005507340A

United States Patent [19]

Alston

[11] Patent Number: 5,507,340

[45] Date of Patent: Apr. 16, 1996

[54] MULTIPLE CIRCUIT CROSS-FEED REFRIGERANT EVAPORATOR FOR STATIC SOLUTIONS

[76] Inventor: Gerald A. Alston, 1011 Claremont St., San Mateo, Calif. 94002

[21] Appl. No.: 444,437

[22] Filed: May 19, 1995

[51] Int. Cl.[6] ..... F28D 1/047

[52] U.S. Cl. ..... 165/150; 165/163; 165/172; 165/DIG. 348

[58] Field of Search ..... 165/150, 163, 165/172, 10; 62/430, 436, 525

[56] References Cited

U.S. PATENT DOCUMENTS

| | | | |
|---|---|---|---|
| 2,707,868 | 5/1955 | Goodman | 165/150 X |
| 2,950,092 | 8/1960 | Di Niro | 165/150 X |
| 4,135,282 | 1/1979 | Neff et al. | 165/150 X |
| 4,403,645 | 9/1983 | MacCracken | 165/10 |
| 4,977,953 | 12/1990 | Yamagishi et al. | 165/10 |
| 4,995,453 | 2/1991 | Bartlett | 165/150 |
| 5,101,884 | 4/1992 | Leidinger | 165/41 |
| 5,423,378 | 6/1995 | Dillenbeck et al. | 165/132 |

*Primary Examiner*—Allen J. Flanigan

[57] ABSTRACT

An improved refrigerant evaporator which uses a plurality of circuits to maximize inner and outer surface areas and cross-feed refrigerant to quickly and uniformly remove heat from static solutions within a containment tank. Refrigerant is equally fed to a plurality of individual circuits 20 from a common inlet manifold 2 located at one side of the coil. Individual circuits 20 alternately incorporate, and do not incorporate, crossover members 23 to carry the incoming refrigerant to the each side of the evaporator such that it simultaneously flows inward from both sides. Individual circuits 20 are additionally arranged such that all which are contained within an evaporator are of identical length thus making the invention particularly well suited for use with non-azeotrope refrigerants. Further, the device does not immerse joints or connections in the cooled medium and performs well in corrosion environments.

7 Claims, 5 Drawing Sheets

MULTIPLE CIRCUIT CROSS-FEED REFRIGERANT EVAPORATOR FOR STATIC SOLUTIONS

BACKGROUND

1. Related Applications

This invention improves the performance of the refrigerator thermal storage tank in my prior application No. 897,274 filed on Jun. 11, 1992, which was subsequently issued as U.S. Pat. No. 5,237,832 on Aug. 24, 1993.

2. Field of Invention

The present invention relates to an improved refrigerant evaporator coil for removing heat from static solutions. More particularly, the coil is especially well suited for use within phase change solution containment tanks in systems which utilize azeotrope and non-azeotrope refrigerants.

3. Discussion of Prior Art

The difficulty in attaining improved heat exchanger efficiency when using a static phase change solution within the confines of a thermal containment tank is well known. The need to maximize the surface area which is in contact with the solution conflicts with the goal of containing as much solution as possible within a minimum amount of space. Increased coil volume reduces the space available within the tank for the phase change solution itself. Additionally, since the solution being cooled is static, the coil configuration must be such that it is equally spaced throughout the tank to provide even cooling. Also, both the evaporator and its support structure must withstand the forces exerted by the repeated expansion and contraction of the surrounding phase change solution as it changes state.

In a typical example of the prior art exemplified by Kleist (U.S. Pat. No. 2,859,945), a single tube is bent so as to allow a maximum length to fit within the space allowed. To increase the total surface area of the coil, a tube of either larger diameter or longer length must be used. Due to mechanical limitations in the tube bending process, selection of a larger diameter tube increases the minimum bend radius thereby decreasing the length of the tubing which will still fit within the same overall dimensions. The result is no net increase in the total surface area of the coil. An additional restriction on increasing the tube diameter is the requirement to maintain sufficient refrigerant velocity to provide adequate oil return.

A similar coil utilizing smaller diameter tubing with increased length is shown by Rodth (U.S. Pat. No. 4,291,546). While providing increased surface area, this approach suffers two major limitations and deficiencies. One is the increased pressure drop which occurs when the refrigerant flows through extended lengths of smaller diameter tubing. This pressure drop reduces, not only the performance of the coil, but the volumetric efficiency of the compressor as well.

The second, related limitation, lies in the increased temperature variation as the refrigerant travels the length of the coil. This temperature variation leads to uneven cooling within the tank and difficulty in maintaining a stable superheat. This is particularly problematic with the new environmentally friendly non-azeotrope refrigerants. These refrigerants are comprised of a blend of several refrigerants which, in an evaporator coil, each boil off at a different rate. This variation is known as temperature "glide" and greatly exacerbates the tendency of evaporator coils which are immersed in phase change solutions to freeze the material nearest the evaporator inlet first. The net effect of this inherent temperature glide is to exaggerate temperature variation throughout the tank such that the expansion valve superheat settings must be so high as to negatively effect the efficiency of the entire system.

Further attempts to increase evaporator surface area and, consequently, evaporator efficiency, have taken the form of the addition of metal fins and similar enhancements of the outer wall of the tubing. Such enhancements have been found to be very helpful in a gas (air) to liquid (refrigerant) heat exchange, such as is found with an air conditioning coil. However, in the liquid/solid (static phase change solution) to liquid (refrigerant) heat exchange with which we are concerned, both the inner and outer surface areas of the evaporator tubing must be increased simultaneously to improve performance. When only one surface area is increased the limiting factor simply becomes the other surface. A variation on this approach can be found in the cooling coil and related support structure by Horton (U.S. Pat. No. 4,356,708) which does little to aid in the removal of heat from the state change solution since only the outer surface of the evaporator tube is enhanced.

It is therefore recognized that one effective way to increase the usable surface area for such evaporators is through the use of multiple small diameter tubes of shorter length. The aggregate total of which provides greater inner and outer surface area while still maintaining refrigerant velocity and minimum pressure drop. An evaporator incorporated in the invention of Fischer (U.S. Pat. No. 4,735,064) teaches such an approach but fails to resolve two problems persistent in the prior art of this type. The first problem stems from difficulty in equally distributing refrigerant to each of the coils. Refrigerant fed to the coil from a linear header as advised overfeeds the coil(s) at the end of the header and underfeeds those at the beginning. The obvious solution of connecting all tubes at a central point proportionately increases the length of each evaporator coil as its distance from this point of origin increases. The steadily escalating length of each individual tube would further increase the second major defect of these evaporators which is, asymmetrical freezing of the state change solutions. Incoming refrigerant feeds all tubes from a common end of the tank thereby chilling, and eventually freezing, this end well before that end at which the tubes exit.

A refrigerant heat exchanger which provides a limited solution to these problems is shown by Bartlett (U.S. Pat. No. 4,995,453). Designed primarily for use with fins as a refrigerant to air heat exchanger, it incorporates a single pressure drop minimizing tube which branches into two separate circuits at the point of the first tube bend. This design provides an improvement in cross-feed pattern and pressure drop when only two circuits are required. However, in expanded embodiments requiring more than two circuits, such as those in large, multi-layered coils, its advantages become increasingly limited and eventually unsuitable since routing complexities require circuits of unacceptable variations in length. An additional disadvantage in this invention is the mid-coil connections between the pressure drop minimizing tube and its circuits which present a corrosion point if the coil assembly is immersed in a static phase change solution.

In addition to those items specifically mentioned above, the prior art has been found to suffer from one or more of the following disadvantages;

a. High production cost which requires the use of expensive tube forming and bending equipment.

b. The use of dissimilar metals and other materials incompatible with refrigerants, oils and/or a wide variety of static solutions.

c. The use of soldered, welded, brazed, pressed, screwed or other connections within the phase change solution containment tank which are susceptible to leakage and corrosion.

d. Unequal spacing throughout the static solution containment tank.

e. Difficulty or inability to incorporate a suitable support structure within the static solution containment tank.

f. Difficulty or inability to be easily modified to accommodate systems of greater or lesser capacity.

g. An inability to consistently withstand the physical stress exerted by the phase change solution.

OBJECTS AND ADVANTAGES

In view of the drawbacks of the prior art, it is an object of this invention to provide an evaporator coil with superior efficiency and performance which is particularly well suited for the removal of heat from static phase change solutions within a containment tank. Specific objects and advantages are;

a. to provide a refrigerant evaporator which uses a plurality of individual circuits to uniformly cool the static phase change solution by distributing the flow of liquid refrigerant evenly throughout the containment tank in which it is placed.

b. to provide a refrigerant evaporator which minimizes the negative effect of glide inherent in non-azeotrope refrigerants by routing a plurality of circuits of equal length such that the numerous component refrigerants which comprise them evaporate at opposing areas of the containment tank.

c. to provide a refrigerant evaporator which does not create excessive pressure drop and is, thereby conducive to maintaining stable superheat with all types of refrigerants.

d. to provide a refrigerant evaporator which has equivalent internal and external tube surface area.

e. to provide a refrigerant evaporator which has increased inner and outer surface area but occupies no more volume than the prior art.

f. to provide a refrigerant evaporator which can be readily adapted to systems of greater or lesser capacity.

g. to provide a refrigerant evaporator which incorporates a simple, economical support structure for the containment tank in which it is housed.

h. to provide a refrigerant evaporator capable of withstanding the forces of expansion and contraction of the medium being cooled.

i. to provide a refrigerant evaporator which allows the use of a single type of compatible material for all portions exposed to the static solution.

j. to provide a refrigerant evaporator which does not expose tubing connections to the static solution.

k. to provide a refrigerant evaporator which can be formed with simple, inexpensive hand tools.

Further objects and advantages will become apparent from a consideration of the drawings and ensuing description.

Figure 1:
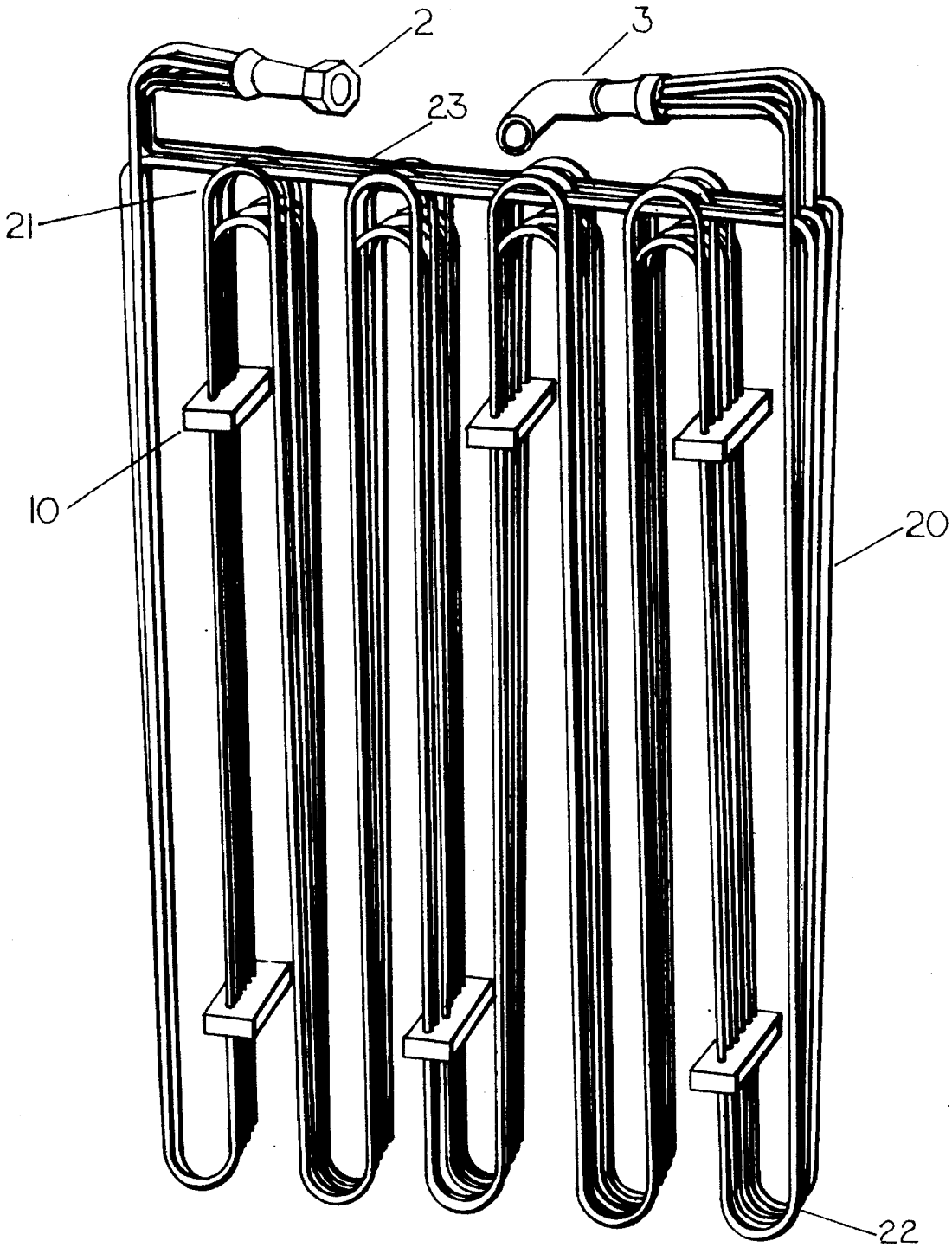
FIG. 1 is a perspective view of a multiple circuit cross feed evaporator according to one embodiment of the present invention.

LIST OF REFERENCE NUMERALS 1. refrigerant metering device
2. inlet manifold
3. outlet manifold
10. circuit support member
11. circuit support member retention screw
12. circuit support member retention nut
13. circuit support path
20. circuit
21. upper U-bend
22. lower U-bend
23. crossover member
24. inlet end
25 outlet end
40. phase change solution containment tank
41. phase change solution

DESCRIPTION OF THE INVENTION

A multiple circuit cross feed refrigerant evaporator in accordance with the invention will be described below with references to FIGS. 1, 2, 3, 4 and 5. The evaporator as shown in FIG. 1 is comprised of an inlet manifold 2 of a type capable of evenly distributing incoming liquid refrigerant to a plurality of separate circuits such as those shown by Eriksson (U.S. Pat. No. 4,922,732), Laveran (U.S. Pat. No. 4,903,763) and others. Said inlet manifold 2 is soldered, welded, formed or otherwise securely connected to inlet end 24 of a plurality of individual circuits 20 which are bent in a serpentine pattern and constructed of a continuous length of stainless steel, copper-nickel, monel or other similar corrosion resistant annealed tubing. Said circuits 20 being of such length, diameter and number so as to achieve the required heat exchange capacity while maintaining the desired internal refrigerant velocity. Adjustment of the radius and number of upper U-bends 21 and lower U-bends 22 on said circuits 20 is such as to ensure that said evaporator coil will symmetrically occupy a containment tank 40 as shown in FIG. 5 and provide an equal cooling distribution throughout a phase change solution 41.

Figure 4:
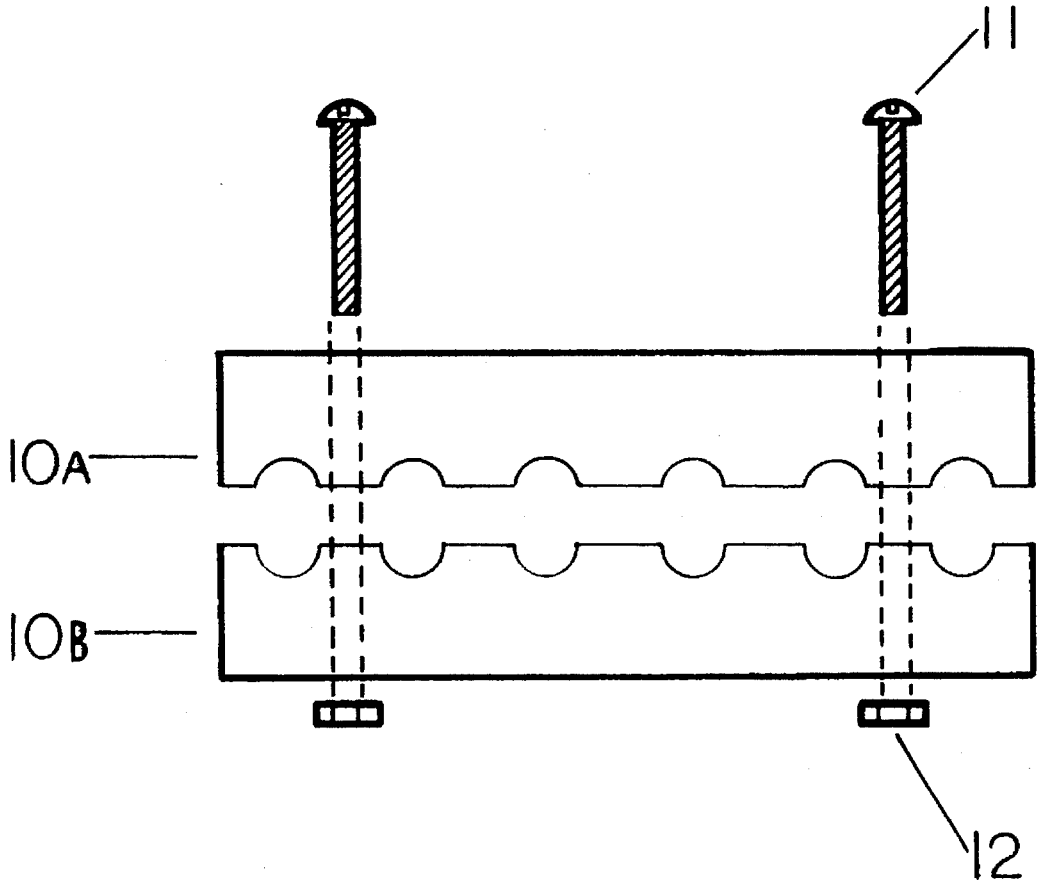
FIG. 4 is an exploded plan view of one embodiment of a typical circuit support member assembly.

In one embodiment, said circuits 20 pass through a circuit support path 13 are held in position with circuit support members 10, a retention screw 11 and a retention nut 12 as shown in FIG. 4. In other embodiments, a variety of means which accurately space and support a plurality of said circuit 20 may be used such as that taught by Nenstiel et al (U.S. Pat. No. 5,050,669).

Figure 2:
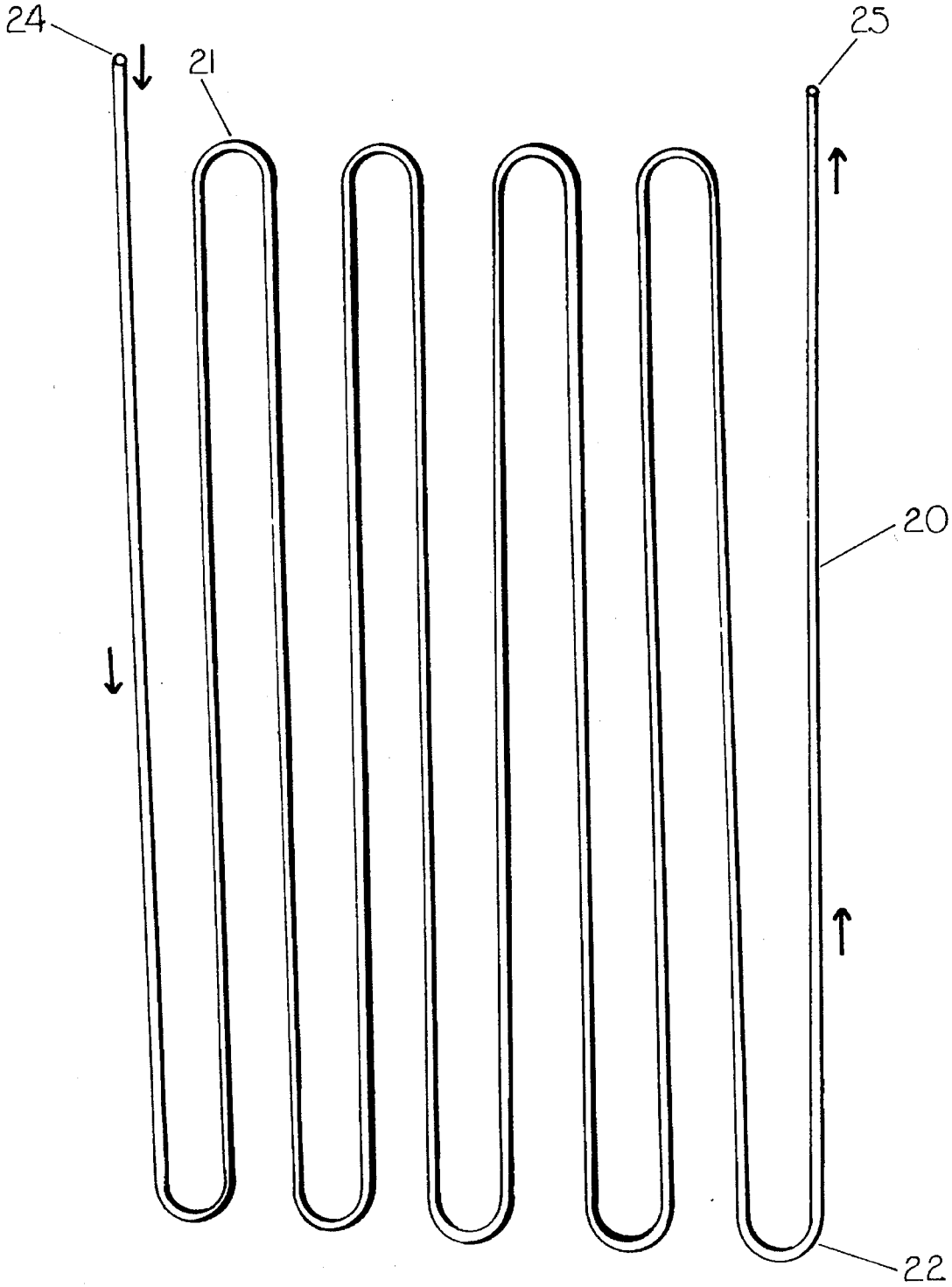
FIG. 2 is a perspective view of a single serpentine circuit without crossover member showing refrigerant flow direction.
Figure 3:
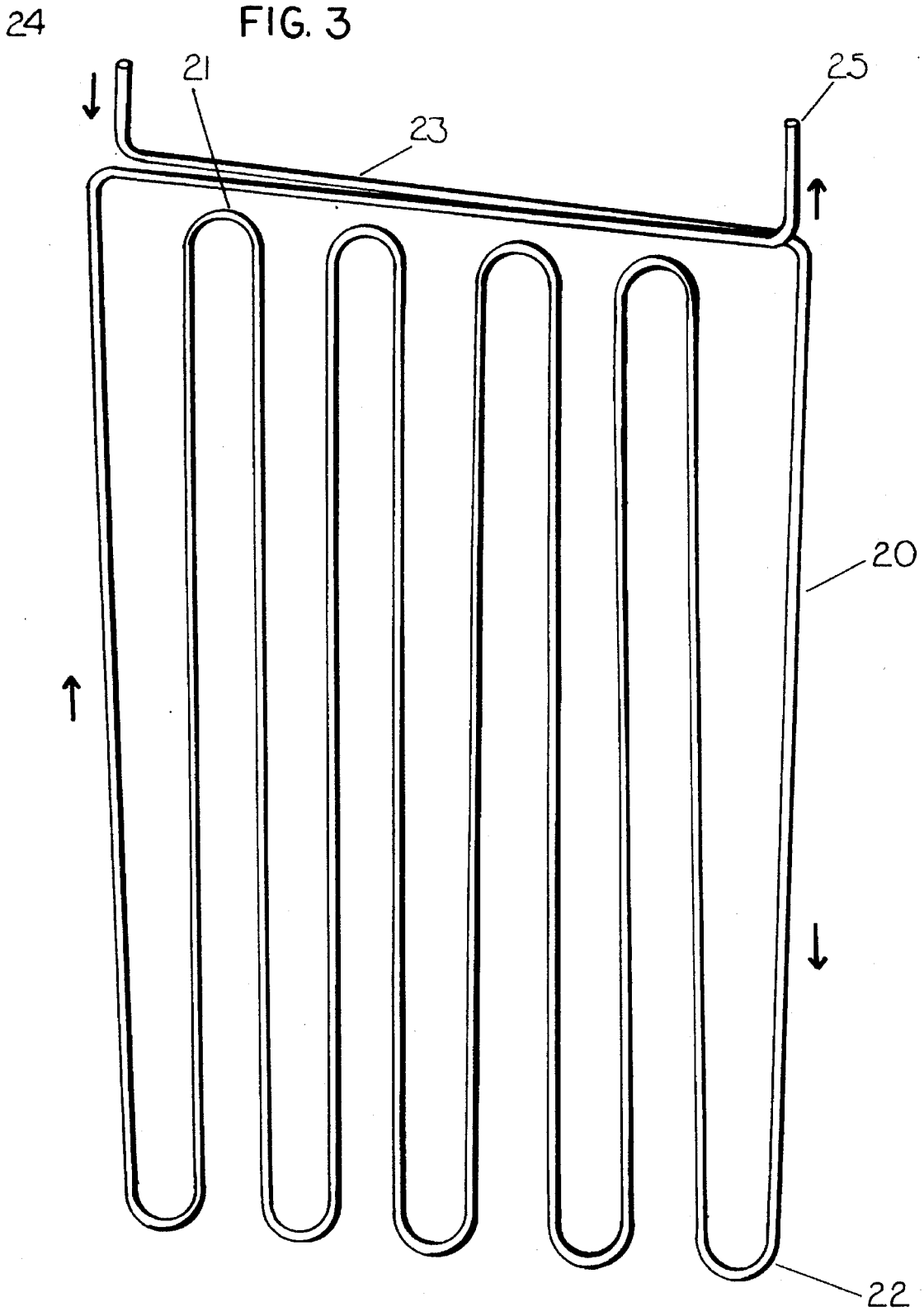
FIG. 3 is a perspective view of a single serpentine circuit with crossover members showing refrigerant flow direction.

Said circuits 20 are arranged which, alternately, incorporate a pair of crossover members 23 as shown in FIG. 3 and which do not incorporate said crossover members 23 as shown in FIG. 2. In said circuits 20 which do incorporate crossover members 23, upper U-bend 21 is positioned so as to allow clearance for said crossover members 23. In circuits 20 which do not include said crossover members 23, said upper U-bend 21 is positioned higher, such that it is even with said crossover members 23 on the adjacent circuit 20 on the assembled evaporator. This higher position for upper U-bend 21 adds overall length to circuit 20 when crossover members 23 are not included such that the overall length of circuit 20 is always the same whether or not said crossover members 23 are used. Lower U-bend 22 is positioned equally whether or not crossover members 23 are used.

Figure 5:
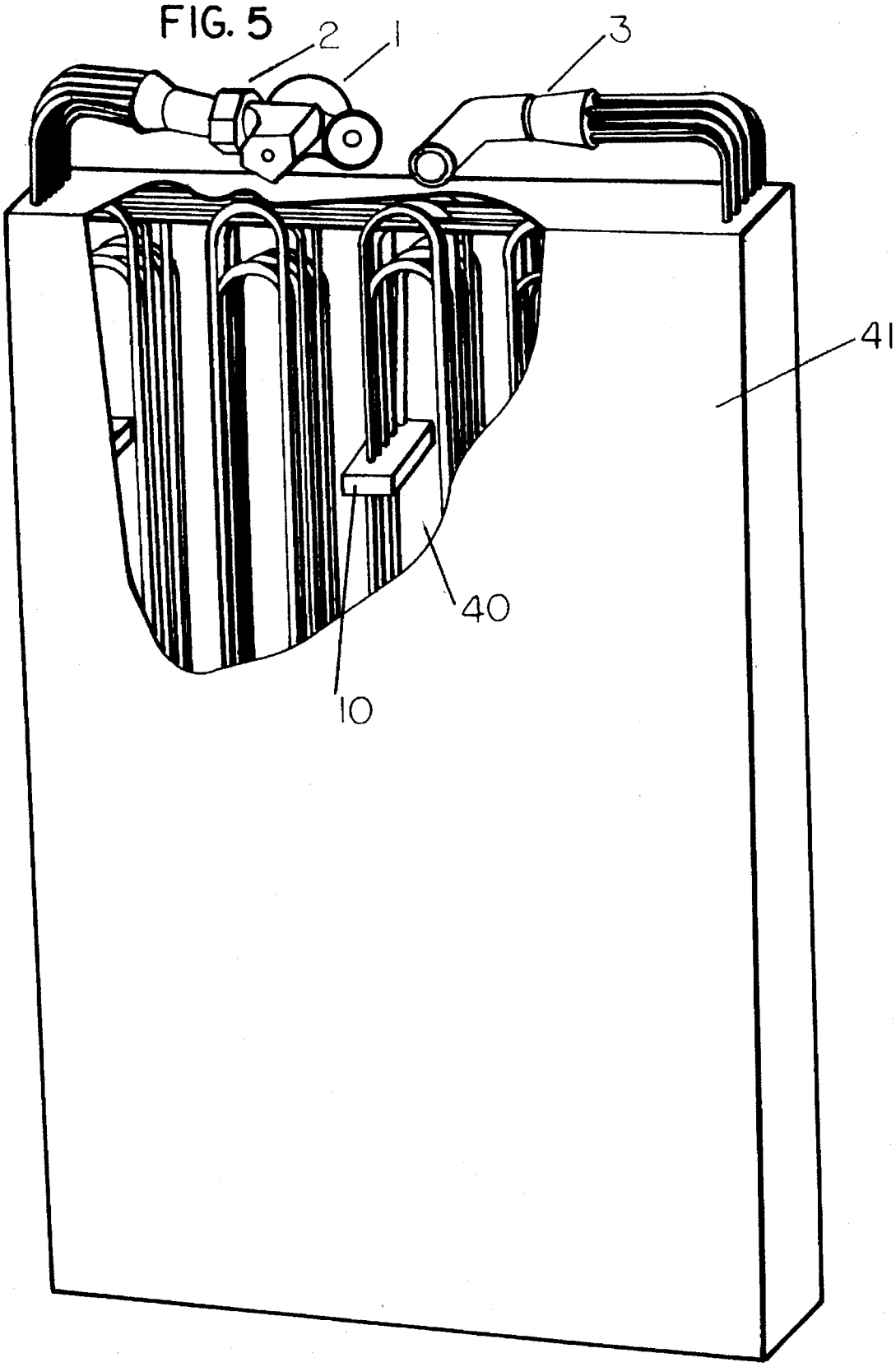
FIG. 5 is a perspective view of a multiple circuit cross feed evaporator with a thermostatic expansion valve immersed in a phase change solution inside a containment tank.

Both inlet end 24 and outlet end 25 are of sufficient length to elevate said inlet manifold 2 and an outlet manifold 3 clear of said phase change solution 41 and said containment tank 40 as shown in FIG. 5. Said outlet manifold 3 which may, or may not, be of similar design to said inlet manifold 2 and of an equal distribution type, is soldered, welded, formed or otherwise securely attached to said outlet end 25.

From the description above, a number of advantages of my multiple circuit cross feed refrigerant evaporator become evident;

a. Both inner and outer tube surface area is greatly increased over that of the prior art without reducing refrigerant velocity within the tubing.

b. Both inner and outer tube surface area is greatly increased without increasing the total volume occupied by the evaporator.

c. Heat can be removed evenly from phase change solutions contained within a tank even by non-azeotrope refrigerants.

d. No tube connections or other corrosion are points are immersed in the state change solution.

e. It can be easily expanded or reduced in size to accommodate variances is system capacities without degrading performance.

f. Since all circuits are of identical length and pressure drop is minimized, exceptionally accurate superheat can be maintained.

g. It can be formed with simple hand tube-bending tools.

h. Circuits are formed of from a continuous length tubing thus eliminating problems with dissimilar metals.

i. The evaporator support structure is simple and economical.

j. It is resistant to physical damage from the expansion and contraction of the state change solution.

OPERATION OF THE INVENTION

In operation, a plurality of circuit 20 and crossover members 23 are immersed in a phase change solution 41 which, in turn, is held in a phase change solution containment tank 40.

Liquid refrigerant enters an inlet manifold 2 at one side of the evaporator from a refrigerant metering device 1 (included for clarity in FIG. 5) whereby it is equally distributed to a plurality of separate circuits 20 by way of an equal plurality of an inlet end 24. Said circuits 20 being arranged in such a manner as to alternately include and not include crossover members 23. Liquid refrigerant which enters a circuit 20 which does not include said crossover members 23 flows linearly toward lower U-bend 22. Liquid refrigerant which enters a circuit 20 which does include said crossover members 23 flows to the opposite side of the evaporator by way of said crossover members 23 before flowing toward said lower U-bend 22. Thus, refrigerant is simultaneously fed from both sides of the evaporator (eg. "cross feed") toward the opposite side.

Upon entering said circuit 20 and said crossover members 23, refrigerant begins to absorb heat from said phase change solution 41 which initiates evaporation. Evaporation continues as refrigerant, in both liquid and gaseous state, flows the length of circuit 20 or until all liquid has evaporated.

Under high load conditions, particularly when said phase change solution 41 is in a fully liquid state, all refrigerant has evaporated by the mid-point of said circuit 20. Also, when the refrigerant is of a non-azeotrope type, the temperature of the flowing refrigerant will vary considerably (eg. "glide") as it evaporates. Under these conditions, the "cross-feed" nature of the evaporator ensures an even removal of heat throughout said phase change solution containment tank 40.

Under lighter load conditions, particularly when said phase change solution 41 is in a partially or fully frozen state, refrigerant continues to evaporate as it flows the entire length of said circuit 20. And, if said circuit 20 includes said crossover members 23, the entire length of the second of said crossover members 23, such that each of a plurality of said circuits 20 form an outlet end 25 at the same side of the evaporator.

When sufficient heat has been removed from the surrounding said phase change solution 41 it begins to change state (ie. freeze) and, with most types of solutions, expand outward as it builds from individual said circuits 20. The collision of multiple fronts of said frozen phase change material 41 creates minor and harmless flexing of upper U-bend 21 and lower U-bend 22 which return to their original positions once melting occurs.

The refrigerant, now entirely evaporated to a gaseous state, flows from the plurality of circuits 20 and outlet ends 25 into a common outlet manifold 3 where it is returned to the system.

SUMMARY, RAMIFICATIONS AND SCOPE

Accordingly, the reader can see that the Multiple Circuit Cross-Feed Refrigerant Evaporator for Static Solutions described by the invention provides significant improvement over the prior art. The invention offers more efficient heat exchange by increasing the surface area exposed to the liquid refrigerant (ie. inner) and equally increasing the surface area exposed to the surrounding phase change solution (ie. outer).

Additionally, the invention;

a. will uniformly remove heat from a phase change solution in a containment tank with both azeotrope and non-azeotrope refrigerants.

b. can be easily changed in size and capacity to fit a wide variety of applications.

c. is constructed with a single type of material with no welds or other connections exposed to the phase change solution, thus making it extremely corrosion resistant.

d. can be form entirely with simple hand tools.

e. provides stable superheat with all types of refrigerants.

f. uses simple support structures to position the coil within the containment tank.

g. will safely withstand the physical rigors of state change of the surrounding solution.

While my above description contains many specificities, these should not be construed as limitations on the scope of the invention, but rather as one preferred embodiment thereof. Many other applications are possible. For example, the coil can be used in many common heat exchanger applications where maximum surface area and uniform heat exchange are desired including;

a. the use of a liquid other than refrigerant (ie. evaporative), such as chilled water or anti-freeze as the heat absorbing medium.

b. the addition of heat to a solidified (ie. frozen) phase change solution with either a gas or liquid heated medium.

c. the exchange of heat between any liquid or gas.

Therefore, the scope of the invention should not be determined by the embodiment illustrated, but by the appended claims and their legal equivalents.

I claim:

1. A heat exchange apparatus for the transfer of heat between a medium at a first temperature and a medium at a second temperature comprising;

a. A distribution means for equally distributing said medium at a first temperature to an inlet end of a plurality of tubular circuits, and b. a plurality of said tubular circuits which include a plurality of opposing 180 degree bends, and c. a plurality of said tubular circuits which include a plurality of said opposing 180 degree bends and a plurality of opposing 90 degree bends so as to form a crossover means at both ends of said tubular circuit, and d. a plurality of support means for securely retaining said plurality of tubular circuits equidistant from each other, and e. a collection means for receiving said first medium from an outlet end of a plurality of said tubular circuits, and f. said distribution means and said collection means being located at opposite sides of the heat exchanger and extended some distance from said plurality of 180 degree bends, and thus arranged such that said plurality of tubular circuits alternately include, and do not include, said crossover means.

2. The heat exchanger of claim 1 wherein said medium at a first temperature is refrigerant and said medium at a second temperature is phase change solution.

3. The heat exchanger of claim 1 wherein said support means is comprised of two identical pieces which, when assembled, form a plurality of equally spaced tubular circuit support paths.

4. The heat exchanger of claim 2 wherein said tubular circuits are of equal length and constructed of continuous tubing.

5. An evaporator for thermal storage refrigeration systems having a plurality of serpentine evaporator tubes of equal length, adjacently positioned and a refrigerant distribution means for equally distributing liquified refrigerant to inlet ends of said plurality of serpentine evaporator tubes, and a. a refrigerant collection means for receiving gaseous refrigerant from outlet ends of said serpentine evaporator tubes, and b. a support means for maintaining an equal distance between said serpentine evaporator tubes, and c. a crossover member operably connected after said inlet ends of alternating said serpentine evaporator tubes, and d. a crossover means operably connected before said outlet ends of said alternating serpentine evaporator tubes.

6. The evaporator of claim 5 wherein said refrigerant distribution means and said refrigerant collection means are held remote from said serpentine evaporator tubes by an extended length of said inlet ends and said outlet ends.

7. The evaporator of claim 5 wherein said support means is comprised of a pair of identical components which, when assembled, form a plurality of tube support paths.

* * * * *